US006948538B1

(12) United States Patent
Nusbaumer et al.

(10) Patent No.: US 6,948,538 B1
(45) Date of Patent: Sep. 27, 2005

(54) LOW MAINTENANCE BALANCED FUELING CRANE, SEALED COUNTERBALANCE THEREFOR, FUEL DRIP COLLECTOR AND ENVIRONMENTAL DRAIN THEREFOR

(76) Inventors: Joseph M. Nusbaumer, 1602 Oak Ridge Ct., Nixa, MO (US) 65714; Ronald Woods, 5186 N. Farm Rd. 159, Springfield, MO (US) 65803

( * ) Notice: Subject to any disclaimer, the term of this patent is extended or adjusted under 35 U.S.C. 154(b) by 41 days.

(21) Appl. No.: 10/839,502

(22) Filed: May 5, 2004

Related U.S. Application Data

(62) Division of application No. 10/419,587, filed on Apr. 21, 2003, now Pat. No. 6,732,770.

(60) Provisional application No. 60/375,793, filed on Apr. 26, 2002.

(51) Int. Cl.[7] ..... B65B 1/04

(52) U.S. Cl. ..... 141/387; 141/88; 141/98; 141/279; 137/615

(58) Field of Search ..... 141/86, 88, 95, 141/96, 98, 192, 250, 279, 284, 387, 391; 137/615

(56) References Cited

U.S. PATENT DOCUMENTS 2,739,778 A 3/1956 Krone et al.
3,651,832 A 3/1972 Meyer
4,050,585 A 9/1977 Wilms
4,109,688 A 8/1978 Jameson
4,122,678 A * 10/1978 Wilson ..... 60/571
4,142,551 A 3/1979 Wilms
4,483,359 A 11/1984 Robertson
4,658,874 A 4/1987 von Meyerinck et al.
5,727,608 A 3/1998 Nusbaumer et al.
5,944,069 A 8/1999 Nusbaumer et al.

* cited by examiner

*Primary Examiner*—Timothy L. Maust
(74) *Attorney, Agent, or Firm*—Richard L. Marsh

(57) ABSTRACT

A fueling crane comprises an extensible boom rotatably associated with a pedestal wherein the extensible boom has a first end rotatably affixed to a fuel inlet pipe mounted on the pedestal and a second end terminating in a fueling nozzle. The extensible boom has at least one elbow joint between the first end and the second end wherein the elbow joint permits the fueling crane to provide fuel to any vehicle spaced from the pedestal within a given radius. The extensible boom is generally disposed in an upright manner wherein the elbow joint is spaced horizontally from but substantially directly above the pedestal and the second end is substantially adjacent the first end when the extensible boom is in a storage position. The improved extensible boom has means for returning the fueling nozzle to the storage position with the fueling nozzle disposed directly over a fuel drip collector thus providing for an environmentally secure fueling station.

13 Claims, 6 Drawing Sheets

LOW MAINTENANCE BALANCED FUELING CRANE, SEALED COUNTERBALANCE THEREFOR, FUEL DRIP COLLECTOR AND ENVIRONMENTAL DRAIN THEREFOR

CROSS-REFERENCE TO RELATED APPLICATIONS

This application is a division of Applicants' parent patent application Ser. No. 10/419,587 filed on 21 Apr. 2003, now U.S. Pat. No. 6,732,770 issued on May 11, 2004 which claims the priority date established by Applicants' provisional application Ser. No. 60/375,793, filed on Apr. 26, 2002.

BACKGROUND OF THE INVENTION

1. Field of the Invention

This invention relates to an articulated fueling crane for fueling transfer operations and particularly for fueling rail supported diesel locomotives and the like. The novel fueling crane has an improved counterbalance which is sealed from the environment and also has a novel drip collector rotatably aligned with an environmental drain for containing fuel dripping from the end of a fueling nozzle fitted at the end of the fueling crane. The articulated fueling crane of this invention is useful for high volume fuel transfer operations where maintenance is irregular and is especially useful in remote locations where maintenance is sparse. The low maintenance, sealed, balanced fueling crane further has an environmental collector to minimize impact of the fueling crane upon the environment. Furthermore, the service life of the fueling cranes of this invention is defined and the fueling cranes are removed at the end of the defined service life and rebuilt for reuse.

2. Prior Art Statement

Fueling cranes are well known in the art. Specifically, fueling cranes are shown in a variety of patents. For instance, see U.S. Pat. No. 4,483,359 issued on Nov. 20, 1984 to Harry Robertson and the U.S. Pat. Nos. 5,727,608 and 5,944,069 issued on Mar. 17, 1998 and Aug. 31, 1999 respectively to Nusbaumer, et al. These patents are drawn to elements of the fueling system and illustrate the specific element with reference to the fueling crane. The known cranes shown in the above-mentioned patents have a counterbalance unit, however, the counterbalance unit is unsealed from the environment and is subject to failure at the chain links immediately above the counterbalance unit. The counterbalance units of the prior art patents also do not return the fuel boom to a position adjacent the nozzle guard and require considerable effort on the part of the fuel boom operator to pull the fueling nozzle toward the fuel tank and hold the fuel nozzle at the fuel tank adapter while securing the fueling nozzle to the fuel tank adapter. Thus, it is possible to spill fuel on the ground between the location of the fuel crane and the fuel tank while drawing the fueling nozzle toward the tank or while the counterbalance attempts to return the fueling nozzle to the position against the nozzle guard. Frequent maintenance is required to keep the cranes of these inventions fully operational.

Further illustrative of the prior art is U.S. Pat. No. 3,651,832, issued on Mar. 28, 1972 to William Meyer. Meyer provides a counterbalanced piping apparatus comprising a base, and inboard conduit swingably connected to the base, an outboard conduit swingably connected to the inboard conduit and an articulated linkage connecting the inboard conduit and the outboard conduit to the base wherein the articulated linkage includes a counterbalancing spring placed in torsion. The counterbalancing spring of Meyer is unprotected from the environment and has no dampening means associated therewith. Therefore, the counterbalanced piping apparatus of Meyer depends upon the skill of the operator to carefully return the outboard nozzle to a storage position. Meyer does not provide for pressure relief, breakaway of the nozzle, collection of dripping from the valve nor containment fuel. The exposed joints of this system require regular maintenance. Krone, et al., in U.S. Pat. No. 2,739,778 issued on Mar. 27, 1956 provide a dampening spring housed within the counterbalancing spring, however, this dampening spring is also exposed to the environment and therefore is subject to fretting corrosion requiring frequent replacement.

Carl Wilms, in U.S. Pat. Nos. 4,050,585 and 4,142,551 issued on Sep. 27, 1977 and Mar. 6, 1979 respectively, provides an articulated loading arm comprising a column rotatably supported on a base, a boom rotatable about a first horizontal axis, an outer arm rotatable about a second horizontal axis parallel to the first horizontal axis, a hydraulic cylinder for exerting a couple tending to rotate the boom and a second hydraulic cylinder for exerting a couple tending to rotate the arm about the second axis. The hydraulic cylinders of Wilms operate the loading arm requiring considerable skill by the operator thereof to control the loading arm thus making the loading arm expensive to construct and operate. The linkages of Wilms are also unprotected from the environment and like Meyer above, no means is provided for dampening, pressure relief, breakaway of the nozzle, collection of dripping from the valve nor containment of fuel. Also, pressurized hydraulic fluid systems are typically high maintenance systems and cannot be used in remote locations.

A fluid transport apparatus comprising an inner fluid conducting conduit pivotally mounted on a mounting structure and an outer fluid conducting conduit section pivotally connected to the outer end of the inner conduit has first and second linear control members parallel to the first conduit for hydraulically controlling the attitude of the outer arm with respect to the horizontal axis. For instance, see the U.S. Pat. No. 4,109,688 issued on Aug. 29, 1978 to Neal Jameson. The entire mechanism of this device is unprotected from the environment, provides no dampening and has no means for pressure relief, breakaway of the nozzle, collection of dripping from the valve nor containment of fuel. Furthermore, with the multitude of joints in an unsealed environment, maintenance must be frequent.

Finally, it is known to provide a fueling arm comprising a filler-neck coupling and at least eight pipe sections serially connected to each other by respective swivel joints each having only one degree of freedom wherein the first three of the swivel joints have axes of rotation parallel to one another, the fueling arm having a headpiece including the filler-neck rotatably connected by a fourth swivel joint to a third pipe section extending from the third swivel joint, the head piece movable to a position in which three of the swivel joints in the headpiece have axes of rotation parallel to one another and perpendicular to the axes of rotation of the other two swivel joints. For instance, see U.S. Pat. No. 4,658,874 issued on Apr. 21, 1987 to Meyerinck, et al. A spring package is affixed to two of the pipes of the headpiece wherein the initial tension of the spring is adjusted to support the weight of the filler-neck coupling to always maintain the filler-neck in its position in space. No dampening of the spring package is provided nor does Meyerinck, et al., provide for pressure relief, breakaway of the nozzle, collection of dripping from the valve nor containment of fuel for an environmentally sound fueling station. Furthermore, though the device of Meyerinck, et al., is described as practically wear free and maintenance free, the presence of eight swivel joints and an open spring package obviously requires frequent maintenance. Additionally, a counterbalance is employed to raise the device to an elevated position and thus operator assistance is also required to place the device of Meyerinck, et al., in a storage position.

SUMMARY OF THE INVENTION

Since railroad maintenance crews are being reduced in an effort to lower operating costs and thus maintenance of fueling cranes is also reduced, it would be advantageous to have a fueling crane for a railroad fueling operation that can be requires little if any maintenance. Therefore, it is an object of this invention to provide a fueling crane having a defined service life wherein the fueling crane comprises an extensible boom rotatably mounted on a pedestal wherein the extensible boom has a first end rotatably affixed to the pedestal and a second end terminating in a fueling nozzle. The extensible boom has at least one sealed elbow joint between the first end and the second end wherein the sealed elbow joint permits the fueling crane to provide fuel to a vehicle spaced from the pedestal. The extensible boom is generally disposed in an upright manner such that the sealed elbow joint is spaced above the pedestal but spaced from a vertical center line of the pedestal with the fueling nozzle located substantially adjacent a nozzle guard when the extensible boom is in a storage position. The extensible boom has an improved means for returning the fueling nozzle to the storage position with the fueling nozzle is disposed directly over a fuel drip collector thus providing for an environmentally secure fueling station.

A significant feature of this invention is to provide a fueling crane having an extended warranty period of approximately five years wherein the fueling crane is replaced with a rebuilt fueling crane of substantially identical design thus starting a new warranty period and the fueling crane removed from service is returned to the factory for re-building subsequent to being returned to service at another fueling station.

Another object of this invention to provide a fueling crane comprising an extensible boom rotatably mounted on a pedestal wherein the extensible boom has a first end rotatably affixed to the pedestal and a second end terminating in a fueling nozzle. The extensible boom has at least one sealed elbow joint between the first end and the second end wherein the sealed elbow joint permits the fueling crane to provide fuel to a vehicle spaced from the pedestal. The extensible boom is generally disposed in an upright manner such that the sealed elbow joint is spaced above the pedestal but spaced from a vertical center line of the pedestal with the fueling nozzle located substantially adjacent a nozzle guard when the extensible boom is in a storage position. The extensible boom has an improved means for dampening the return of the fueling nozzle to the storage position.

An aim of this invention is to provide a fueling crane comprising an extensible boom rotatably mounted on a pedestal wherein the extensible boom has a first end rotatably affixed to the pedestal and a second end terminating in a fueling nozzle, the fueling crane having means for dampening the return of the fueling nozzle to the storage position wherein the means for dampening is protected from the environment and thus fully functional in all climes.

A feature of this invention to provide a fueling crane comprising an extensible boom rotatably mounted on a pedestal wherein the extensible boom has a first end rotatably affixed to the pedestal and a second end terminating in a fueling nozzle. The extensible boom has at least one sealed elbow joint between the first end and the second end wherein the sealed elbow joint permits the fueling crane to provide fuel to a vehicle spaced from the pedestal. The extensible boom is generally disposed in an upright manner such that the sealed elbow joint is spaced above the pedestal but spaced from a vertical center line of the pedestal with the fueling nozzle located substantially adjacent a nozzle guard when the extensible boom is in a storage position. The fuel inlet pipe feeding the extensible boom has a pressure relief for returning expanding fuel from the extensible boom through the fuel inlet pipe to a storage tank.

Yet another object of this invention is to provide a fueling crane requiring considerably less effort to extend the fueling boom to a fueling position wherein the fueling boom automatically returns to a storage position upon release by the operator of the fueling crane.

Still another feature of this invention to provide a fueling crane comprising an extensible boom rotatably mounted on a pedestal wherein the extensible boom has a first end rotatably affixed to the pedestal and a second end terminating in a fueling nozzle. The extensible boom has at least one sealed elbow joint between the first end and the second end wherein the sealed elbow joint permits the fueling crane to provide fuel to a vehicle spaced from the pedestal. The extensible boom is generally disposed in an upright manner such that the sealed elbow joint is spaced above the pedestal but spaced from a vertical center line of the pedestal with the fueling nozzle located substantially adjacent a nozzle guard when the extensible boom is in a storage position. The extensible boom is generally disposed in an upright manner such that the sealed elbow joint is spaced above the pedestal but spaced from a vertical center line of the pedestal with the fueling nozzle located substantially adjacent a nozzle guard when the extensible boom is in a storage position. The fuel inlet pipe feeding the extensible boom has means for monitoring the pumping pressure in the fueling system and for monitoring the static pressure of the column of fluid within the fueling crane.

A goal of this invention is to provide a fueling crane comprising an extensible boom rotatably mounted on a pedestal wherein the extensible boom has a first end rotatably affixed to the pedestal and a second end terminating in a fueling nozzle. A fuel inlet pipe associated with the pedestal and the fueling crane has a lockable drain fitting associated therewith for returning fuel from the fueling crane to an environmentally safe environment when maintenance on the fueling crane is desired.

Finally, it is an object of this invention to provide an articulated fueling crane for fueling transfer operations and particularly for fueling rail supported diesel locomotives and the like. The articulated fueling crane of this invention is useful for high volume fuel transfer operations where regular maintenance is sparse. The low maintenance, sealed, balanced fueling crane thus has an improved counterbalance which is sealed from the environment and also has a novel drip collector rotatably aligned with an environmental drain for containing fuel dripping from the end of a fueling nozzle fitted at the end of the fueling crane.

DESCRIPTION OF THE PREFERRED EMBODIMENTS

While the various features of this invention are hereinafter described and illustrated as a fueling crane having an expected service life of at least five years, the fuel crane comprising an extensible boom rotatably mounted on a pedestal wherein the extensible boom has a first end rotatably affixed to the pedestal and a second end terminating in a fueling nozzle, the fueling crane having means for dampening the return of the fueling nozzle to the storage position wherein the means for dampening is protected from the environment and is thus fully functional in all climes, it is to be understood that the various features of this invention can be used singly or in various combinations thereof to provide for a fueling crane warranted for use in all climes of up to five years without regular maintenance as can hereinafter be appreciated from a reading of the description.

Figure 1:
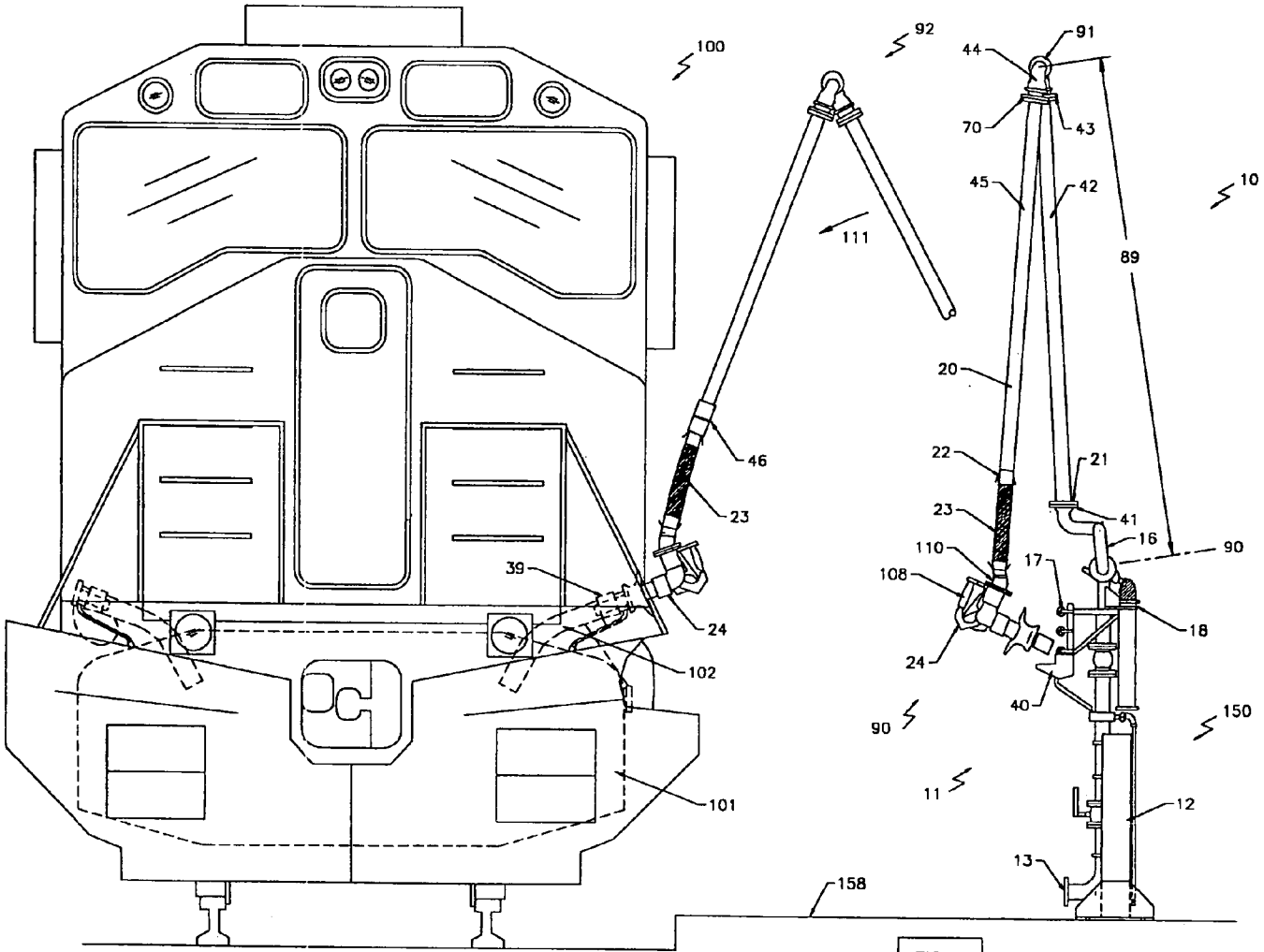
FIG. 1 is a frontal plan view of a rail locomotive at a fueling station with a side plan view of the improved fuel crane shown in a storage position and a broken away view showing the extensible sections extended to a vehicle and having the fueling nozzle locked thereonto.
Figure 2:
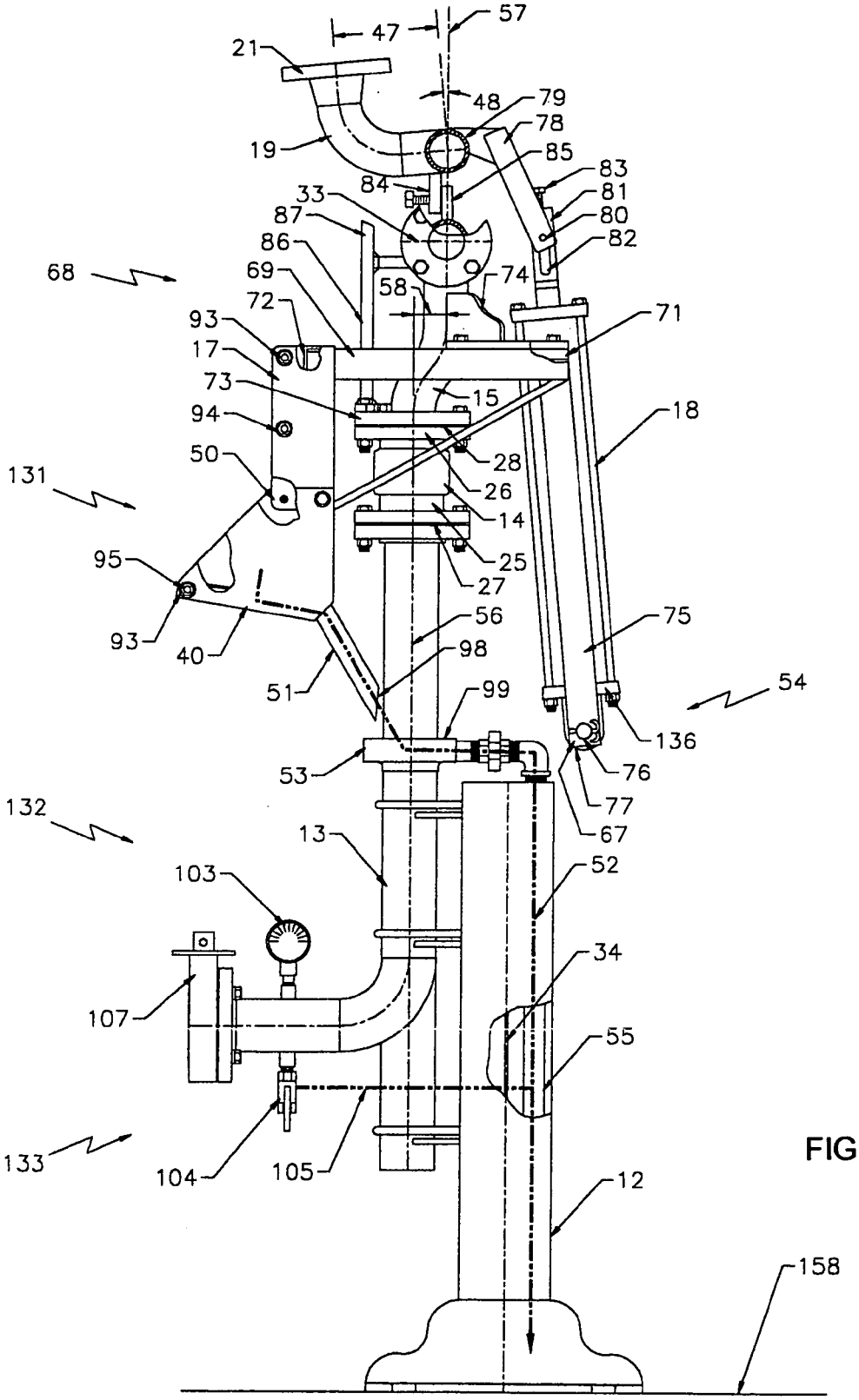
FIG. 2 is an enlarged side plan view of the improved fuel crane of FIG. 1.

Referring now to FIGS. 1 and 2, a fueling station, generally represented by the numeral 10, comprises a fueling crane 11 having an extensible boom 20 rotatably associated with a pedestal 12, extensible boom 20 having a first end 41 mounted upon a boom mount 16 wherein boom mount 16 is rotatably affixed to a fuel inlet pipe 13 mounted on pedestal 12. Extensible boom 20 has a second end 22 terminating in a fueling nozzle 24, extensible boom 20 further having at least one elbow joint 44 between first end 41 and second end 22, elbow joint 44 permitting fueling crane 11 to provide fuel to a vehicle 100 spaced from pedestal 12. Extensible boom 20 is generally disposed in an upright manner wherein second end 22 is substantially adjacent first end 41 when extensible boom 20 is in a storage position generally shown on the right-hand side of FIG. 1 with the numeral 90. Extensible boom 20 further has means 88 for returning nozzle 20 to storage position 90, means 131 for collecting fuel dripping from fueling nozzle 24 after cessation of a fueling operation, means 54 for transferring collected fuel from means 131 for collecting, means 132 for monitoring pressure within fueling crane 11 and means 133 for relieving pressure in fuel inlet pipe 13. Means 88 for returning and means 131 for collecting are carried on a frame work 69 which is rotatably mounted upon a Tee 15 carrying boom mount 16, means 88 for returning adapted to automatically return fueling nozzle 24 to storage position 90 with the terminal end 39 of fueling nozzle 24 disposed directly over means 131 for collecting upon release of fueling nozzle 24 by an operator thereof. Continuing to refer to FIGS. 1 and 2, fueling crane 11 is preferably rotatably mounted upon pedestal 12 at a central location 150 in fueling station 10. Fueling crane 11 comprises fuel inlet pipe 13, a vertically disposed rotatable union 14, substantially vertical Tee 15, boom mount 16, extensible boom 20, nozzle guard 17, dripping pan 40, drain collar 53, drain piping 55, counterbalance assembly 18, a flexible hose section 23 and a fueling nozzle 24 wherein an outer half 26 of union 14, vertical Tee 15, boom mount 16, extensible boom 20, nozzle guard 17, dripping pan 40, counterbalance assembly 18, flexible hose section 23 and fueling nozzle 24 comprise a rotatable assembly 68 freely rotatable about fuel inlet pipe 13. Extensible boom 20 is adapted to reach from pedestal 12 to at least a fuel tank adapter 102 on a vehicle 100 being fueled such that nozzle 24 may be easily attached to fuel tank adapter 102 as will become fully apparent by a careful reading of the following description. Fueling cranes 11 have been constructed to service vehicles 100 at various distances circumferentially around pedestal 12 wherein at least one fueling crane 11 has been constructed to service vehicles in a 40-foot diameter of central location 150 of fueling station 10, though of course fueling cranes 111 may be constructed of virtually any reach consistent with envelope parameters around fueling station 10.

Figure 3:
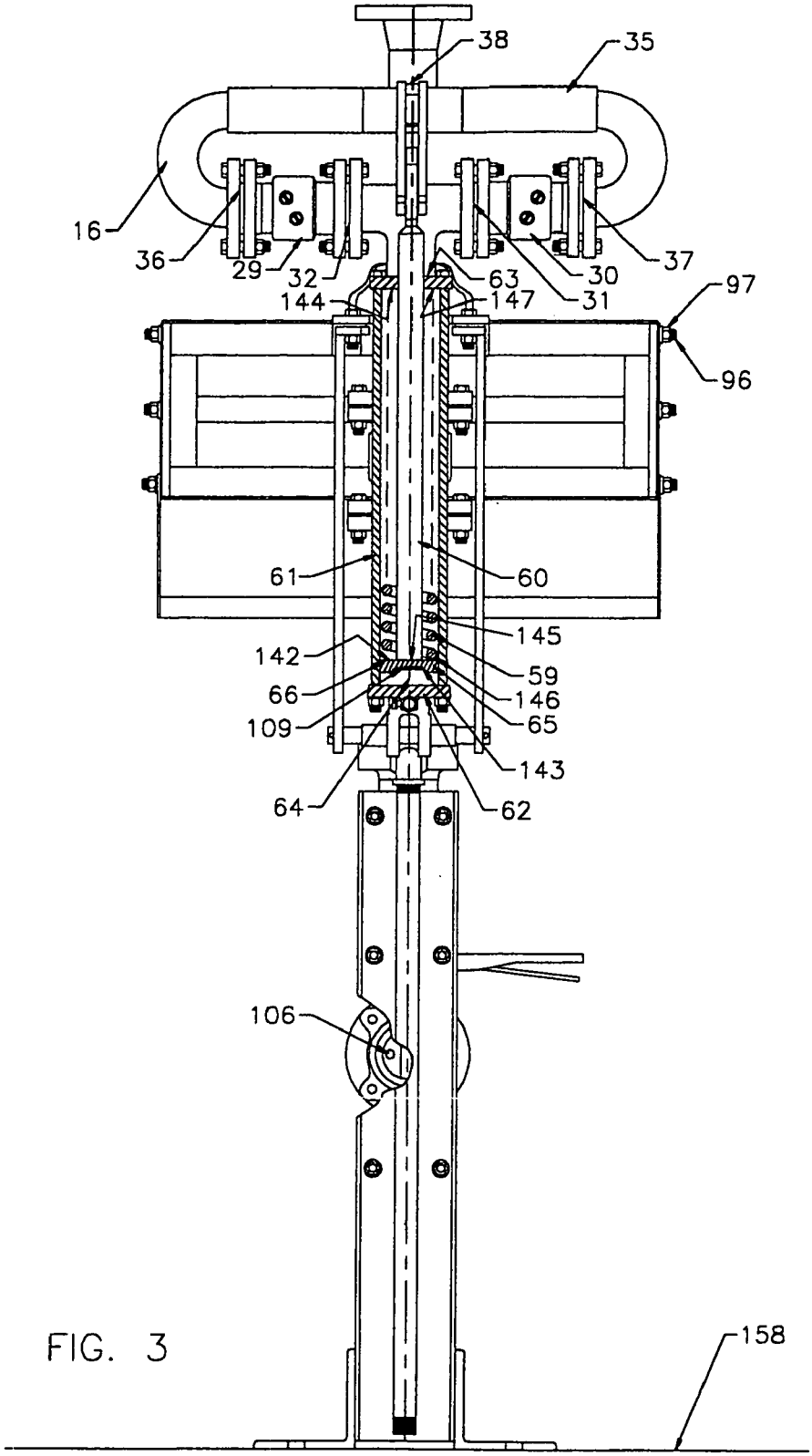
FIG. 3 is an enlarged rear plan view of the improved fuel crane of FIG. 1.
Figure 4:
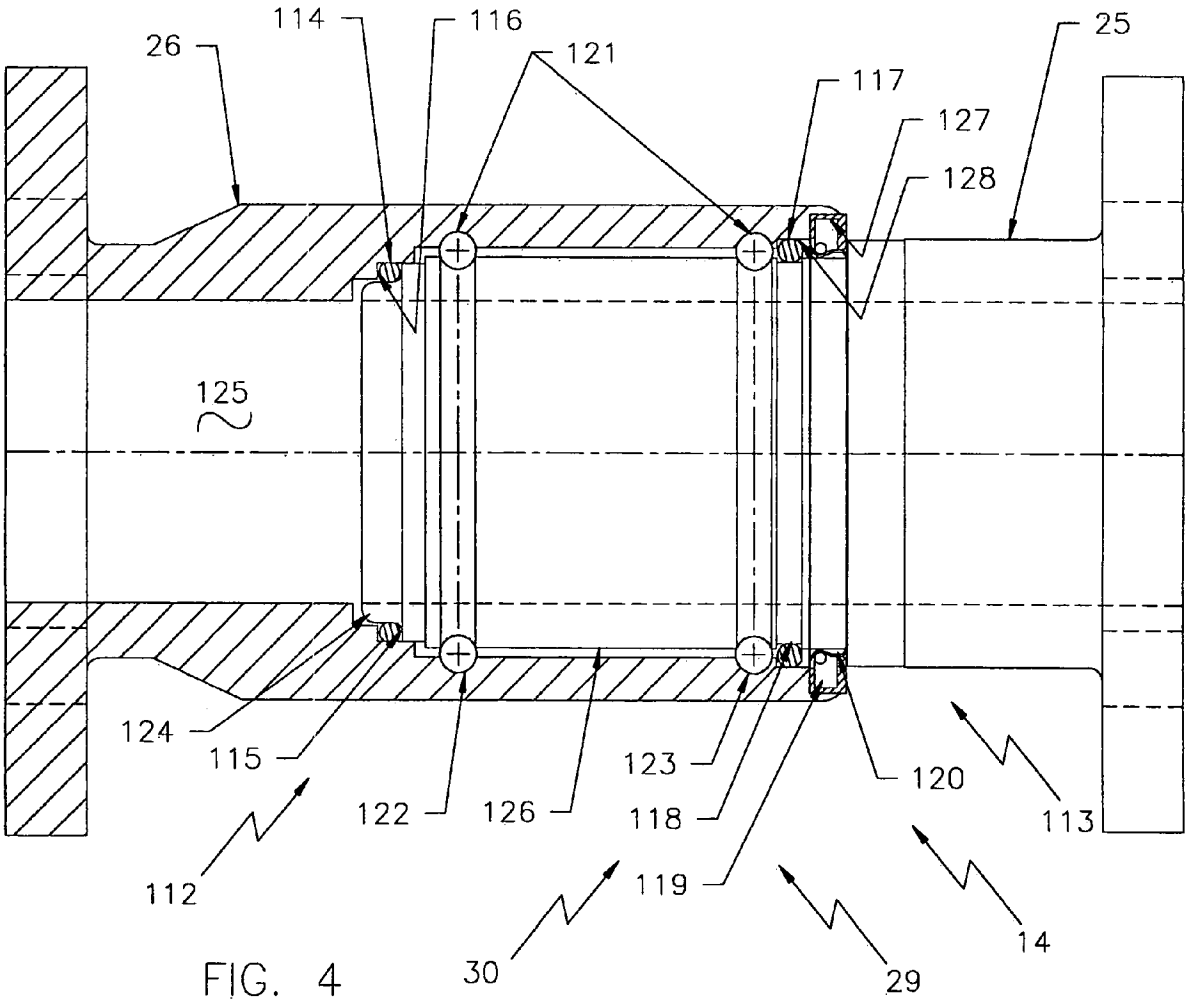
FIG. 4 is a greatly enlarged sectional view of the sealed unions of the improved fuel crane of FIG. 1.

As best observed in FIGS. 2 and 4, sealed union 14 comprises an inner union half 25 extending upwardly from the upper end 27 of fuel inlet pipe 13 and an outer union half 26 affixed to a lower end 28 of vertical Tee 15 wherein centrally disposed union 14 comprises a three hundred sixty-degree rotatable coupling around fuel inlet pipe 13 at central location 150. Outer union half 26 fits over the outer peripheral surface 126 of inner union half 25, union halves 25, 26 having double sealing surface areas 112, 113 therebetween thus sealing union 14 from environmental factors. Thus, a first element of the extended warranty period of fueling crane 11 is provided as union 14 is sealed from environmental factors and therefore useful in locations where maintenance may be irregular. Referring also to FIG. 3, boom mount 16 has rotatable union assemblies 29, 30 affixed to opposed ends 31, 32 of Tee 15 thus providing rotation of extensible boom 20 about a horizontal axis 33, horizontal axis 33 substantially perpendicular to a vertical axis 34 of pedestal 12. Rotatable union assemblies 29, 30 are also mounted to opposed ends 36, 37 of an elongated C-shaped yoke 35 wherein C-shaped yoke 35 has J-shaped joint 19 permanently affixed on the center 38 thereof, and thus, union assemblies 29, 30, C-shaped yoke 35, J-shaped joint 19 and Tee 15 comprise boom mount 16. As rotatable union assemblies 29, 30 are also sealed units, similar in construction to union 14, rotatable union assemblies 29, 30 thus are also usable throughout the warranty period of fueling crane 11. Sealed, rotatable union assemblies 29, 30 comprise a second element of the extended warranty of fueling crane 11.

Extensible boom 20 has a first end 41 of a first section 42 affixed to a mount end 21 of J-shaped joint 19 wherein first section 42 is generally vertically disposed upwardly from mount end 21 when extensible bloom 20 is in the retracted or storage position 90 shown in FIG. 1. Though first section 42 is generally disposed upwardly, first section 42 is angled from a true vertical position by an angle 48 to assist an operator of fueling crane 11 to pivot fueling crane 11 fully around upright fuel inlet pipe 13. A sealed, hollow jointed elbow coupling 44 is affixed to opposite end 43 of first section 42 and second section 45 of extensible boom 20 is joined to the open end 70 of sealed elbow coupling 44.

Sealed elbow coupling 44 allows extensible boom 20 to be extended outwardly from pedestal 12 as shown in FIG. 1. Nozzle end 22 of second section 45 of extensible boom 20 has a breakaway coupling 46 affixed thereto with short flexible hose section 23 extending from breakaway coupling 46. Flexible hose section 23 terminates in automatic fueling nozzle 24 wherein fueling nozzle 24 is adapted to provide fuel to the fuel tank 101 of a vehicle 100 receiving fuel at station 10 such as the locomotive shown in FIG. 1. Automatic fueling nozzle 24 may be of any type known in the industry such as those described and claimed in U.S. Pat. Nos. 3,042,084; 4,441,533; 5,727,608; 5,944,069 these patents incorporated herein by this reference hereto.

Sealed unions 29 and 30 are shown in partial cross section in FIG. 4 wherein the detail construction of unions 29 and 30 are described, it being understood that union 14 is substantially identical in construction though rotated to a vertical position. As previously stated, outer union half 26 fits over the outer peripheral surface 126 of inner union half 25, union halves 25, 26 having double sealing areas, 112, 113 therein wherein the first sealing area 112 is a pressurized sealing surface and second sealing area 113 is a containment sealing region under substantially ambient pressure. First sealing area 112 has an O-ring 114 on a face 115 of nose 124 of inner union half 25, O-ring 114 mating against a recess 116 internally disposed in outer union half 26. O-ring 114 is placed under a slight radial compression in first sealing area 112 and is lubricated by the presence of fuel within the bore 125 of unions 14, 29 and 30. Second sealing area 113 also contains an O-ring 117 retained in a groove 118 on outer peripheral surface 126 of inner union half 25, groove 118 spaced apart from face 115. O-ring 117 is also in slight compression against an inner annular recessed face 128 in outer union half 26. A double lip seal 119 is contained in a second groove 120 close to groove 118 on outer peripheral surface 126 wherein double lip seal 119 is spring loaded against an inner peripheral end groove 127 of outer union half 26. Unions 29 and 30 have a double row of ball bearings 121 disposed in spaced apart races 122, 123 thereby allowing unions 29, 30 to rotate throughout the full range of motion required to move fueling crane 11 from its storage position 90 to a fully extended position 92 to be connected to fueling adapter 102 of vehicle 100. Ball bearings 121 and double sealing areas 112, 113 thus make unions 29, 30 of boom mount 16 maintenance free throughout the warranty period of fueling crane 11 thereby overcoming the major maintenance shortcomings of existing fueling cranes. Upright union 14 is substantially identical in construction, however, at least race 123 is replaced with a roller bearing race and bearing 121 in that race 123 is a roller bearing to ensure free rotation and support the weight of rotatable assembly 68. Though the preferred construction of unions 14, 29, 30 has been herein recited, it is within the scope of this invention to provide for other sealed rotatable joints in the place of unions 14, 29 and 30.

As can be readily appreciated by a viewing of FIG. 2, J-shaped joint 19 has a horizontal offset 47 and an angular offset 48 as measured from transverse center 49 of C-shaped yoke 35 thus placing first section 42 in a generally upward disposition at a slight angle outwardly from fuel inlet pipe 13 and pedestal 12. Second section 45 then hangs generally vertically downwardly from elbow coupling 44 and as fueling nozzle 24 is disposed at an angle to flexible hose section 23 at nozzle end 22 of second section 45, terminal end 39 of fueling nozzle 24 returns substantially to the same point adjacent nozzle guard 17 upon release of fuel nozzle 24 by an operator thereof J-shaped joint 19, in cooperation with improved counterbalance assembly 18 has been found by the instant inventors to facilitate return of fueling nozzle 24 of extensible fueling boom 20 to a position adjacent nozzle guard 17 with terminal end 39 of fueling nozzle 24 overlying a novel dripping pan 40 of this invention. Dripping pan 40 is mounted on a lower end 50 of nozzle guard 17 wherein nozzle guard 17 is also affixed to Tee 15 and thus is rotatable therewith. Dripping pan 40 has a drain spout 51 affixed thereto that aligns with a drain collar 53 fixedly mounted to fuel inlet pipe 13, drain collar 53 having means 54 for transferring collected fluid attached thereto to transfer fluid from drain collar 53 along a path 52 shown by a dot-dash line to a holding tank (not shown) through drain piping 55 thereby establishing environmentally sound fueling practice at fueling station 10.

In the prior art fueling cranes cited above, the extensible boom is disposed upon a flange aligned with the center of boom mount and thus generally lies directly above the center of the boom mount. The center of gravity of the prior art extensible boom therefore is close to a vertical axis of fuel inlet pipe and heretofore also generally through the vertical axis of the boom mount. In the prior art fueling cranes, the fueling nozzle returns toward the nozzle guard with considerable force as the center of gravity of the previous fueling cranes is so close to the axis of the fuel inlet pipe. This force has often been sufficient to destroy the nozzle guard and thereafter do damage to the inlet pipe, and the rotatable joint supporting the fueling crane. Additionally, when a counterbalance assembly of the prior art fueling crane fails, the extensible boom of the prior art device does not return the fueling nozzle toward a nozzle guard and may thus allow the fueling nozzle to contact the ground surface 158 around the fueling station thus introducing contaminants into the terminal end of the nozzle. These contaminants may then be introduced into the fuel tank of the vehicle or the fuel tank of a subsequent vehicle.

In the instant invention, J-shaped joint 19 is displaced from and disposed at angle 48 from vertical axis 57, vertical axis 57 set back from vertical axis 56 a short distance 58 to assist with returning fueling nozzle 24 against nozzle guard 17 thus putting terminal end 39 directly over dripping pan 40. Offset 47 of J-shaped joint 19 from center 49 of boom mount 16 is between 1 and 20 inches and most preferably about 6 inches while short distance 58 may be up to 15 inches but is most preferably about 2 inches. Angle 48 is between 5 and 45 degrees however fueling crane 11 best performs when angle 48 is about 5 degrees. Thus the center of gravity of extensible boom 20 is displaced from horizontal axis 33 substantially thus assisting the operator in rotating fueling crane 11 about fuel inlet pipe 13, extending boom 20 from the storage position 90 to the fueling position 92 and placing fueling nozzle 24 of extensible boom 20 into fuel tank adapter 102 of vehicle 100 to be fueled. Coupled with angled offset 48, horizontal offset 47, the length of sections 42, 45, placement of the center of gravity of extensible boom 20 outward from axis 57 and only a little force by the operator is required to retain fueling nozzle 24 at tank adapter 102 thus allowing the operator to easily attach fueling nozzle 24 thereto. It has been found by the inventors of the instant invention that the force required by the operator of fueling crane 10 of this invention has been reduced by at least half from a minimum of at least 20 pounds force to not more than 10 pounds force to rotate fueling boom 20 about pedestal 12 and extend fueling boom 20 to its full reach from pedestal 12.

Fueling crane 11 preferably has a means 88 for returning extensible boom 20 to a storage position 90, means 88 for returning comprising at least one sealed hydraulic cylinder 61 containing a return spring 59 therein, hydraulic cylinder 61 swingably mounted upon frame work 69, hydraulic cylinder 61 having a piston rod 60 extending from the top end 63 thereof. Improved means 88 for returning further comprises means 130 for adjusting and means 133 for dampening, means 130 for adjusting associated with terminal end 81 of cylinder rod 61 and means 133 for dampening contained within cylinder 61. As can be observed by reference to FIG. 2 or 5, counterbalance assembly 18 of improved means 88 for returning comprises a spring 59 placed around a piston rod 60 and inside of a hydraulic cylinder 61 wherein hydraulic cylinder 61 has a viscous dampening fluid contained therein and substantially filling all the free space surrounding spring 59 and portion 64 below piston 66. Observing now in the partial cross section portions of the hydraulic cylinder 60 in FIGS. 3 and 5, one end 146 of return spring 59 rests upon the top 142 of piston 61, piston 61 secured to one end 145 of piston rod 61 and the other end 147 of return spring 59 abutting against the internal surface 144 of first closure end 135 of hydraulic cylinder 61. Since dampening cylinder 61 is capped at bottom end 62 and sealed around piston rod 60 at top end 63, the viscous dampening fluid contained therein is protected from the environment whereas a dampening cylinder of the prior art was open at top end and thus accumulated liquid within the cylinder. Since the liquid accumulating on the prior art devices was usually water, the water would freeze in cold climes thus rendering fueling crane unusable. Furthermore, the accumulated water was immiscible with but heavier than the oil generally used in cylinder and thus would pass through the bleed valve holes in piston into the bottom of cylinder causing the oil to be eventually dispelled from top end thus replacing the oil with water. Since water is lower in viscosity than the oil used, the dampening characteristics of counterbalance assembly were significantly lowered. This resulted in the rapid return of the fueling nozzle toward the nozzle guard and subsequent destruction of either the fueling nozzle and/or the nozzle guard. In the improved counterbalance assembly 18 of this invention, cylinder 61 is sealed around piston rod 60 at upper end 63, thus retaining the dampening fluid within cylinder 61 and thereby maintaining the proper dampening characteristics. The dampening fluid used in cylinder 61 is a non-freezing liquid and preferably also has a substantially constant viscosity throughout a wide temperature range. Glycols, alcohols and specially compounded oils are to be used to advantage as dampening fluid for counterbalance assembly 18 of this invention.

Means 134 for dampening comprises a foot valve 109 disposed against the bottom surface 143 of piston 66, foot valve 109 allowing rapid flow of fluid from the volume of hydraulic cylinder 60 above top 142 of piston 66 through piston 66 to a portion 64 of cylinder 60 below piston 66 as piston 66 moves from a position proximate internal surface 148 of second closure end 136 of hydraulic cylinder 60 but restricts flow through piston 66 as piston 66 moves toward internal surface 148 of second closure end 136 of cylinder 60. Enlarged bleed holes 65 are disposed through piston 66 above foot valve 109 thus allowing for rapid flow of fluid through piston 66 as foot valve 109 easily deflects with flow of fluid through bleed holes 65 from top 142 of piston but only small bleed holes are provided through foot valve 109 to restrict flow of fluid from bottom 143 of piston 66 thus providing a dampening effect upon return of fueling boom 20 to storage position 90.

Improved means 88 for returning comprises a counterbalance assembly 18 affixed to and carried by rotatable assembly 68 with a frame work 69, frame work 69 also carrying nozzle guard 17 and dripping pan 40. Frame work 69 is preferably bolted around Tee 15 having counterbalance assembly 18 bolted to one end 71 thereof and nozzle guard 17 bolted to the opposed end 72. Frame work 69 may be affixed at the lower flange 73 of Tee 15 or as preferably shown in FIGS. 2 and 3, frame work 69 is affixed to a bracket 74 welded onto Tee 15. Cylinder 61 of counterbalance assembly 18 is mounted between a pair of straps 75 which are suspended downwardly from end 71 of frame work 69 wherein cylinder 61 is rotatably mounted to straps 75 with a pin 76 through holes 77 in a terminal end 67 of straps 75. Thus, cylinder 61 may rotate about pin 76 through a small angle to accommodate movements of extensible boom 20 as extensible boom 20 is moved from a storage position 90 to a fueling position 92. Preferably, holes 77 in straps 75 are permanently lubricated bushings or are constructed of a thermoplastic material such that rotation about pin 76 continues throughout the warranty period of fueling crane 11. Stops 84, 85 are affixed to C-shaped yoke 35 and Tee 15 respectively and are provided to prevent extensible fueling boom 20 from assuming a fully vertical position as it is difficult to direct the movement of extensible fueling boom 20 therefrom. Alternately, straps 75 could be journaled at end 71 of frame work 69 and cylinder 61 firmly attached at end 67 of straps 75 to provide for the aforementioned movement of counterbalance assembly 18. Stops 84, 85 are preferably welded to the respective piping sections and overlap in order to stop movement of C-shaped yoke 35 thus arresting the movement of extensible fueling boom 20. In FIG. 2, portions of boom mount 16 have been broken away and portions have been shown in section to show attachment of stops 84, 85 and the stopping relationship produced thereby. Since top end 63 is sealed and piston rod 60 passes through this sealed end 63, counterbalance assembly 18 is also maintenance free and able to operate throughout the warranty period of fueling crane 11 thus constituting a third element of the extended warranty of fueling crane 11.

Piston rod 60 of cylinder 61 is slidably affixed to a bracket 78 disposed on centerline 38 of C-shaped yoke 35 generally directly opposite J-shaped joint 19, bracket 78 welded to C-shaped yoke 35 and thus directly acting thereupon. Bracket 78 spans around terminal end 81 of piston rod 60 and has a pin 80 passing through a slot 82 in terminal end 81 such that the balance of fueling crane 11 may be adjusted by a means 130 for adjusting to be described hereinafter. Another stop 86 is provided on rotatable assembly 68 to prevent extensible fueling boom 20 from being disposed at an angle wherein it is difficult for extensible fueling boom 20 to automatically return to the storage position 90 as shown in FIG. 1. As can be observed in FIG. 2, stop 86 is bolted to lower flange 73 of Tee 15 and extends upwardly therefrom. The upper end 87 of stop 86 is welded to Tee 15 to support upper end 87. Stop 86 bears against a stop 84 of J-shaped joint 19 as extensible fueling boom 20 is lowered to its lowermost angle with first section 42 disposed at an angle of about 45 degrees from the horizontal. In the construction of one fueling crane 11, as the centerline distance 89 from axis 33 to the center 91 of elbow coupling 44 is about 14 feet and the distance to terminal end 39 of fueling nozzle 24 from center 91 of elbow coupling 44 is slightly greater, it is readily apparent that terminal end 39 of fueling nozzle 24 may be disposed in a fuel tank adapter at a distance of at least 20 feet from pedestal 12. As rotatable assembly 68 of fueling crane 11 allows fueling crane 11 to be rotated throughout a full circle around pedestal 12, it is also fully appreciated that such a fueling crane 11 may fuel vehicles 100 having fuel tank adapter 102 within a 40-foot diameter circle of central location 150 of fueling station 10. Typically, in a fueling station 10 for diesel locomotives, the track spacing from central location 150 is between 10 and 20 feet therefore, fueling crane 11 is suitable for installation in rail yards for fueling vehicles 100 such as locomotives on the spaced apart tracks. Of course, it is possible to construct fueling cranes 11 having a greater or lesser reach consistent with the envelope parameters around central location 150 and thus this invention is not limited to any specific fueling crane 11, fueling station 10 or any components of fueling crane 11.

Figure 5:
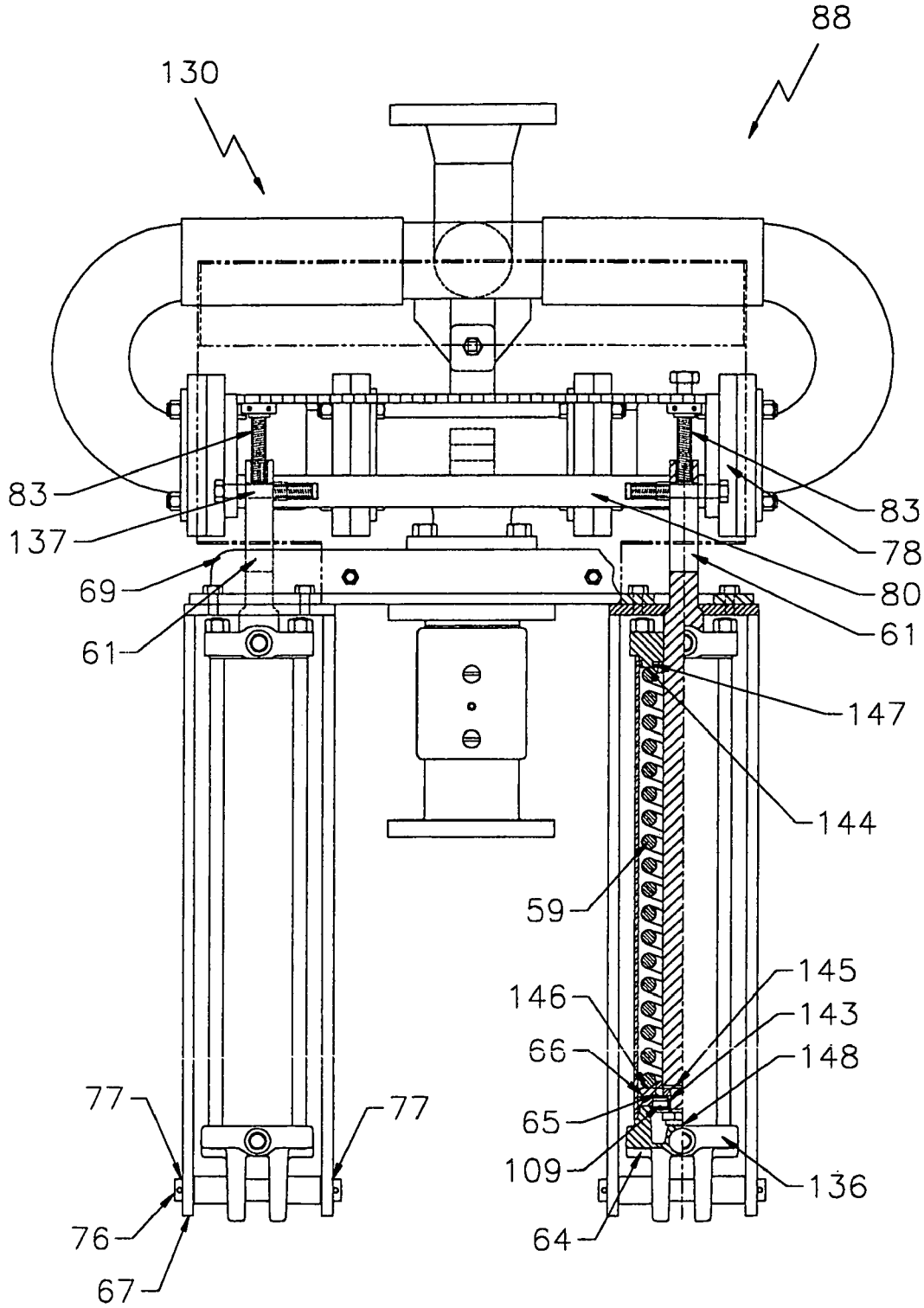
FIG. 5 is an enlarged rear plan view of an alternate embodiment of the counterbalance assembly for the improved fuel crane of FIG. 1 showing one cylinder in partial cross section.
Figure 6:
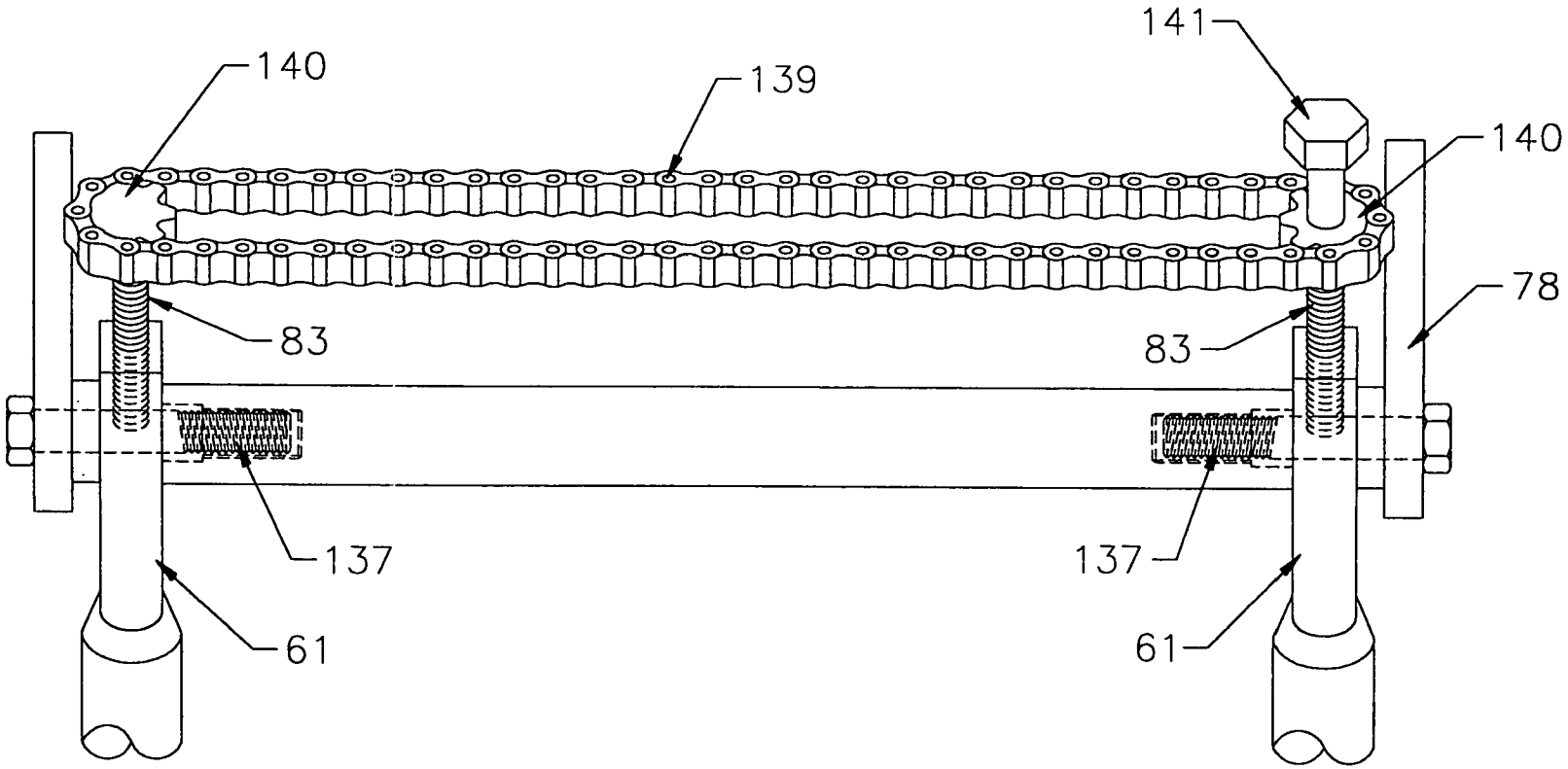
FIG. 6 is a greatly enlarged, upper rear perspective view of the means for adjusting for the counterbalance assembly of the alternate embodiment in FIG. 5.

Means 130 for adjusting comprises an adjusting screw 83 disposed into terminal end 81 of piston rod 61 extending through a first closure end 135 of hydraulic cylinder 60, adjusting screw 83 bearing against a link pin 80 disposed through a slot 82 in terminal end 81 of piston rod 61, link pin 80 associated with bracket 78 eccentrically affixed to extensible fueling boom 20. Bracket 78 may have an eccentric 79 affixed thereto wherein eccentric 79 is welded directly to boom mount 16 opposite J-shaped joint 19 or bracket 78 may be affixed to flanges 36, 37 having link pin 80 disposed therethrough and extending between piston rods 61 extending from two separate hydraulic cylinders 60 spaced apart on and carried by frame work 69 as shown in FIGS. 5 and 6 of a second embodiment of the means 88 for returning of this invention. For ease of assembly, link pin 80 may comprise multiple parts wherein bolts 137 join link pin 80 to brackets 78. In this second embodiment of FIGS. 5 and 6, means 130 for adjusting further comprises a positive drive element 138 between adjusting screw 83 on one piston rod 61 to adjusting screw 83 on the other piston rod 61, positive drive element 138 comprising a pair of chain sprockets 140, a roller chain 139 and a single point adjustment head 141 wherein one chain sprocket 140 is affixed atop each adjusting screw 83 with chain 139 reeved tightly around sprockets 140. Only one adjusting screw 83 has adjustment head 141 thereon wherein adjusting head may be a hexagon shaped bolt head as shown in FIG. 6, however, adjusting head 141 is preferably a tamper proof socket head requiring the insertion of a specially shaped male member into the socket head in order to effectively turn adjusting head 141 thus providing security to fueling crane 11. Since fueling crane 11 is warranted for service of at least five years without need for regular maintenance, the balance of fueling crane 11 set at the factory or at installation at fueling station 10 by selective turning adjusting head 141 with the specially shaped male member, fueling crane 11 generally does not requiring further adjustment after installation. Though the preferred embodiment for means 130 for adjusting has been described, various alternatives for simultaneously moving adjusting screws 83 such as belts and pulleys, pairs of bevel gears, hydraulic, electric or pneumatic motors are possible within the scope of this invention.

Nozzle guard 17 comprises a rack of horizontal bars 93 each covered with a replaceable rubber element 94 wherein horizontal bars 93 are spaced apart vertically on nozzle guard 17 such that terminal end 39 of fueling nozzle 24 is adapted to come to rest against at least one of horizontal bars 93 when extensible fueling boom 20 is returned to its storage position 90. As terminal end 39 of fueling nozzle 24 bears against one of horizontal bars 93, terminal end 39 also lies directly over dripping pan 40 and hence any fuel dripping from terminal end 39 is captured in dripping pan 40 and thus flows along path 52 to an environmentally safe receiving tank (not shown) for subsequent disposal. Dripping pan 40 is affixed at lower end 50 of nozzle guard 17 and extends beyond a vertical plane passing through horizontal bars 93 such that dripping pan 40 may begin catching any fuel dripping from terminal end 39 before fueling nozzle 24 is fully returned to its storage position 90, however, it should be appreciated here that dripping pan 40 does not extend outwardly so far as to interfere with return of extensible fueling boom 20 to its storage position 90. Dripping pan 40 is also fitted with a horizontal bar 93 at its outer extent 95, horizontal bar 93 at outer extent 95 also covered with replaceable rubber element 94 to prevent damage to fueling nozzle 24. Referring to FIG. 3, it should be readily apparent that horizontal bars 93 preferably have elongated bolts 96 passing therethrough having nuts 97 on at least one end thereof for ease of removal of horizontal bar 93 from nozzle guard 17 or dripping pan 40 for replacement of rubber element 94 thereon. As dripping pan 40 is a part of rotatable assembly 68 and may be rotated fully around fuel inlet pipe 13, means 54 for transferring fluid from dripping pan 40 is provided on dripping pan 40, around fuel inlet pipe 13 and toward an environmental storage tank (not shown). Means 54 for transferring fluid comprises a drain spout 51 centrally located on and attached to dripping pan 40 wherein drain spout 51 is communicable with dripping pan 40. Drain spout 51 extends downwardly and inwardly from dripping pan 40 and has its free open end 98 lying directly over drain collar 53, drain collar 53 having an open upper surface 99 disposed fully around fuel inlet pipe 13 such that fuel dripping from free open end 98 of drain spout 51 is collected in drain collar 53 for further transfer to the environmental storage tank through drain piping 55. Drain piping 55 may be any suitable piping but preferably is threaded black iron piping used for fuel service. Drain piping may be disposed within pedestal 12 or may be attached to the exterior thereof.

Fueling station 10 has additional safety and environmental features associated therewith. Fuel inlet pipe 13 mounted to pedestal 12 has a lockable drain fitting 104 fitted therein adapted for returning fuel from fueling crane 11 through fuel inlet pipe 13 to an environmentally safe environment such as the aforementioned environmentally safe receiving tank wherein the returned fuel is contained within the environmentally safe receiving tank. Lockable drain fitting 104 is connected to drain piping 55 along path 105 with drain piping similar to drain piping 55, drain piping 55 preferably located within pedestal 12. Lockable drain fitting 104 may also be used to relieve built up pressure in fueling station 10 comprising fueling crane 11 and fuel inlet pipe 13, especially where fueling station 10 may be located in extremely warm conditions and fuel expansion within fueling station 10 causes pressure therewithin to exceed a predetermined value. Lockable drain fitting 104 preferably is a pressure relief valve set at the predetermined pressure or may be a manual valve operated by an operator of fueling station 10. Pressure within fueling station 10 is monitored by reference to pressure gauge 103 fitted into fuel inlet pipe 13, preferably adjacent to lockable drain fitting 104 and a fueling station shutoff valve 107 associated with fuel inlet pipe 13. Accumulated pressure within fueling station 10 is generally relieved through a pressure bleed orifice 106 disposed within shutoff valve 107 wherein the accumulated pressure usually flows through pressure bleed orifice 106, however, when temperatures are extremely high, pressure in the entire system up to and including fueling nozzle 24 may be elevated and thus it is especially valuable to have pressure gauge 103 and lockable drain valve 104 automatically relieve the accumulated pressure by releasing fuel into drain piping 55 along path 105 and thence along path 52 into the storage tank. Pressure bleed orifice 106 preferably comprises only one way communication across shutoff valve 107 and thus is a check valve on the side 129 of fueling station shutoff valve 107 within fuel inlet pipe 13 of fueling station 10 as it is desired to isolate one fueling station 10 from other fueling stations 10 fed by a common line from a fueling pump feeding multiple fueling stations 10.

Referring again to FIGS. 1 and 2, when an operator desires to fuel vehicle 100 at fueling station 10, the operator grasps a handle 108 on fueling nozzle 24 and draws fueling crane 11 toward vehicle 100 in the direction of arrow 111 causing second section 45 to be displaced from a position adjacent first section 42 and first section 42 to be displaced from the substantially vertical position assumed while fueling crane 11 is in the storage position 90. As fueling crane 11 moves, J-shaped joint 19 rotates about horizontal axis 33 carrying bracket 78 therealong. Since bracket 78 is linked to piston rod 60 of cylinder 61, piston 66 within cylinder 61 moves in an upward direction compressing spring 59. When piston 66 moves, fluid above piston 66 passes through bleed orifices 65 therein forcing foot valve 109 to be displaced from piston 66 to allow for rapid flow of fluid from above piston 66 into bottom portion 64 of cylinder 61. Flow of fluid through piston 66 does not significantly impede the movement of fueling crane 11 and thus the operator is easily able to draw fueling nozzle 24 toward fuel tank adapter 102, rotate fueling nozzle 24 about breakaway assembly 46, readily place terminal end 39 of fueling nozzle 24 into fuel tank adapter 102 and secure fueling nozzle 24 to tank adapter 102 with the locking ring associated with fueling nozzle 24. The operator then opens the fluid flow valve within handle 108 of fueling nozzle 24 in the conventional manner described in the aforementioned fueling nozzle patents and further operates shutoff valve 107 to begin fueling of vehicle 100. Since fueling nozzle 24 is locked to fuel tank adapter 102, fueling crane 11 remains in the extended position 92 shown in FIG. 1 though there is a little return force generated at fueling nozzle 24 by counterbalance assembly 18, this return force sufficient to return fueling crane 11 to the storage position 90 yet sufficiently low enough to permit the operator to extend fueling crane 11 to vehicle 100. Upon cessation of the fueling operation, the operator closes the fluid flow valve in fueling nozzle 24, causes shutoff valve 107 to be closed and unlocks fueling nozzle 24 from fuel tank adapter 102. The operator can then release the grasp of handle 108 and fueling crane 11 will return to its storage position 90 by the small return force generated by spring 59 within cylinder 61. As fueling crane 11 returns to its storage position 90, piston 66 moves downwardly within cylinder 61, but foot valve 109 restricts the flow of fluid from bottom portion 64 through piston 66 as foot valve 109 significantly blocks bleed orifices 65. Preferably, foot valve 109 has a much smaller bleed hole disposed therethrough for inhibiting flow therethrough. Since spring 59 within cylinder 61 acts upon bracket 78 affixed to J-shaped joint 19, first section 42 is drawn to its substantially upright position while second section 45 hangs substantially vertically downwardly from elbow coupling 44. Once released by the operator, fueling nozzle 24 generally turns inwardly as shown in the storage position 90 by a biasing action of the breakaway coupling, flexible hose section 23 and/or a swivel joint 110 associated with fueling nozzle 24. Thus, terminal end 39 of fueling nozzle 24 approaches nozzle guard 17 and overlies dripping pan 40 thus allowing fuel remaining in fueling nozzle 24 to drip into dripping pan 40 and be returned to the containment tank.

Fueling crane 10 preferably has a defined service life even though fueling crane 10 is still serviceable at fueling station 10, however since rotatable unions 14, 29 and 30, counterbalance assembly 18, flexible hose section 23 and fueling nozzle 24 have moving components and thus are subject to failure, and means 131 for collecting, means 54 for transferring, means 132 for monitoring and means 133 for relieving are subject to damage, it is advantageous to remove these parts from service at the end of effective service and thus it has been found by the inventors hereof that it is most advantageous to remove the entirety of fueling crane 10 at the end of the defined service life, replace same with a new or rebuilt fueling crane 10 and rebuild the removed fueling crane 10 for additional service. Accordingly, each fueling crane is numbered and a complete record of the date of manufacture, date of installation, dates of rebuilding and subsequent dates of reinstallation is maintained by the manufacturer such that the defined service life of each fueling crane 10 may monitored. Preferably, the warranty period of fueling crane 11 is at least five years without maintenance and thus fueling crane 11 of this invention overcomes the major shortcoming of the prior art fueling cranes, that is, of failure of the return mechanism to properly return the fueling nozzle to the nozzle guard. Other shortcomings of the prior art fueling cranes overcome by this invention comprise providing for an environmentally friendly fueling station by having dripping pan 40, drain spout 51 and means 54 for transferring fluid, maintenance free rotating union 14, maintenance free unions 29, 30 and elbow coupling 44, pressure relief of fueling crane 11 and containment of fuel from station 10. Since fueling crane 11 of this invention is maintenance free throughout the period, fueling cranes 11 may be place in low maintenance areas and scheduled for exchange at the end of the specified warranty period. When exchanged, fueling crane 11 removed from a low maintenance area is replaced with a new or rebuilt fueling crane 11 of this invention thereby starting a new warranty period. Fueling crane 11 removed from the low maintenance area is then returned to the factory for rebuilding all parts, though of course, it should be understood that fueling cranes 11 of this invention is still fully functional at the time of removal from field service.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

We claim:

1. In a fueling crane comprising an extensible fueling boom rotatably mounted upon a vertical fuel inlet pipe affixed to a mounting pedestal, said extensible fueling boom comprising a pair of substantially equal length sections of rigid tubing, a sealed, hollow jointed elbow coupling, a boom mount, a substantially vertical Tee, a rotatable bearing, a flexible hose section, an automatic fueling nozzle, a nozzle guard, a framework and a means for returning, said extensible fueling boom having a first end of a first section of said rigid tubing affixed to a mount end of said boom mount, said sealed, hollow jointed elbow coupling affixed to an opposite end of said first section and to one end of said second section of said rigid tubing, said second section having a breakaway coupling affixed to an opposite end thereof with said short flexible hose section extending therefrom, said flexible hose section terminating in said automatic fueling nozzle, said boom mount rotatably mounted upon said substantially vertical Tee, said substantially vertical Tee having said framework mounted thereto and rotatably carried thereby, said framework carrying said nozzle guard and said means for returning, the improvement wherein said boom mount comprises a J-shaped joint which offsets said extensible fueling boom from a substantially vertical alignment with said vertical tee, said J-shaped joint facilitating extension of said extensible fueling boom from said storage position.

2. A fueling crane as in claim 1 wherein said J-shaped joint cooperates with said means for returning for drawing said first section to a generally vertically disposed position so said sealed, hollow jointed elbow coupling of said extensible fueling boom is disposed substantially vertically above said J-shaped joint ensuring that said automatic fueling nozzle safely returns to a position directly above said nozzle guard.

3. A fueling crane as in claim 2 wherein said first section is angled from a true vertical position by a small angle and said second section is offset from said the first section by said sealed, hollow jointed elbow coupling to assist with pivoting said fueling crane around upright fuel inlet pipe.

4. A fueling crane as in claim 1 wherein said offset of said extensible fueling boom from a substantially vertical alignment with said vertical tee reduces by half the effort required to extend said extensible fueling boom from said storage position.

5. A fueling crane as in claim 1 wherein said sealed, hollow jointed elbow comprises an outer union half and an inner union half, said outer union half fitting over an outer peripheral surface of said inner union half, said union halves having double sealing areas therebetween wherein a first sealing area is a pressurized sealing surface under pressure within said fueling crane and a second sealing area of said double sealing areas is a containment sealing region under substantially ambient pressure.

6. A fueling crane as in claim 5 wherein said first sealing area has an O-ring disposed on a face of nose of said inner union half, said O-ring mating against a recess internally disposed in said outer union half wherein said O-ring is placed under radial compression in said first sealing area, said O-ring lubricated by fuel within a bore of said union halves.

7. A fueling crane as in claim 6 wherein said second sealing area contains an O-ring retained in a first groove on an outer peripheral surface of said inner union half, said first groove spaced apart from said face of said nose, said O-ring slightly compressed against an inner annular recessed face of said outer union half.

8. A fueling crane as in claim 7 wherein a double lip seal is contained in a second groove adjacent said first groove on said outer peripheral surface and wherein said double lip seal is spring loaded against an inner peripheral end groove of said outer union half.

9. A fueling crane as in claim 5 wherein said union halves have a double row of ball bearings disposed in spaced apart races thereby allowing said unions to rotate throughout a full range of motion required to move said fueling crane from said storage position to a fully extended position wherein said automatic fueling nozzle is releasably connected to a fueling adapter of a vehicle to be fueled.

10. A fueling crane comprising at least two substantially equal lengths of rigid tubing, at least one sealed, hollow jointed elbow coupling, a boom mount, a substantially vertical Tee, a rotatable bearing, a flexible hose section, an automatic fueling nozzle, a nozzle guard, a framework a means for returning and a means for dampening, said lengths of rigid tubing joined together by said sealed, hollow jointed elbow couplings, a terminal section of said rigid tubing having a breakaway coupling affixed to a free end thereof with said short flexible hose section extending therefrom, said flexible hose section terminating in said automatic fueling nozzle, said boom mount rotatably mounted to said substantially vertical Tee, said substantially vertical Tee having said framework mounted thereto and rotatably carried thereby, said framework carrying said nozzle guard and said means for returning, the improvement wherein said means for returning and said means for dampening are sealed within a hydraulic cylinder and said fueling crane has an unique identifying number to facilitate maintenance and repair records.

11. A fueling crane as in claim 10 wherein said hydraulic cylinder has a piston rod extending from one end thereof.

12. A fueling crane as in claim 11 wherein said piston rod has means for adjusting associated with said one end.

13. A fueling crane as in claim 12 wherein said means for adjusting comprises an adjusting screw associated with said end of said piston rod, said adjusting screw having a tamper proof socket head.

* * * * *